US007712804B2

(12) United States Patent
Leyden et al.

(10) Patent No.: US 7,712,804 B2
(45) Date of Patent: May 11, 2010

(54) METHOD AND APPARATUS FOR CONTROLLING A ROPE

(76) Inventors: Roger Leyden, 115 New Abbey Dr., Inverness, IL (US) 60010; Allen Greenberg, 239 River Rd., Deerfield, IL (US) 60015; Kris Michael Southerland, 2109 E. Old Hicks Rd., Palatine, IL (US) 60074

( * ) Notice: Subject to any disclaimer, the term of this patent is extended or adjusted under 35 U.S.C. 154(b) by 304 days.

(21) Appl. No.: 11/880,761

(22) Filed: Jul. 24, 2007

(65) Prior Publication Data

US 2009/0025188 A1 Jan. 29, 2009

(51) Int. Cl.
*B63B 21/54* (2006.01)
*B25J 1/04* (2006.01)

(52) U.S. Cl. ..... 294/19.1; 114/221 R; 114/230.25

(58) Field of Classification Search ..... 114/221 R, 114/230.25, 230.26; 294/19.1; 119/801–804
See application file for complete search history.

(56) References Cited

U.S. PATENT DOCUMENTS 2,811,127 A 10/1957 Palsson
3,677,597 A 7/1972 Stipek
3,841,685 A 10/1974 Kolodziej
3,918,385 A 11/1975 Wallace
3,945,335 A * 3/1976 Kratz ..... 114/221 R
4,004,539 A * 1/1977 Wesson ..... 114/221 R
4,635,986 A 1/1987 Johns
4,667,617 A 5/1987 Molitor
4,932,700 A * 6/1990 Hart ..... 294/19.1
5,009,181 A 4/1991 Upchurch
5,116,260 A 5/1992 Upchurch
5,292,160 A 3/1994 Deichman
5,699,748 A 12/1997 Linskey et al.
5,799,602 A 9/1998 Trillo

* cited by examiner

*Primary Examiner*—Dean J Kramer
(74) *Attorney, Agent, or Firm*—Wood, Phillips, Katz, Clark & Mortimer

(57) ABSTRACT

A method of directing a rope around a cantilevered support including the steps of: a) providing an apparatus having i) an elongate pole with a proximal region and a distal region spaced from each other in a lengthwise direction, and ii) a rope engaging assembly at the distal region and having at least one surface facing away from the proximal region; b) configuring the rope so that the rope bears against the at least one surface and a portion thereof is thereby formed to be generally U-shaped opening towards the proximal region with the rope in an operative position; c) holding a second portion of the rope and the elongate pole at the proximal region to bear the rope against the at least one surface to maintain the "U" shape; and d) manipulating the elongate pole to cause the U-shaped portion of the rope to be directed around the cantilevered support.

29 Claims, 4 Drawing Sheets

METHOD AND APPARATUS FOR CONTROLLING A ROPE

BACKGROUND OF THE INVENTION

1. Field of the Invention

This invention relates to a method and apparatus for controlling a rope, as to facilitate drawing of a boat towards a docking space.

2. Background Art

Recreational boaters and those in the shipping industry are commonly faced with the problem of drawing a boat/ship (hereinafter "a boat") towards a docking space with the boat in relatively close proximity thereto.

Typically, boats are able to maneuver under their own power, or be pushed by a tugboat, to a position adjacent to a dock at which the boat will ultimately be secured. The most challenging aspect of docking occurs typically when the boat is required to be secured along a dock at a mooring that runs parallel to the boat length and has a length equal to, or only slightly greater than, that of the boat. This maneuver can be compared to parallel parking a car.

Commonly, the boat will be preliminarily situated with its length parallel to the length of the mooring, whereupon hooks and/or ropes are used to draw the boat in a sideways direction to against the dock. Typically at such docks, there are a series of cleats that cantilever upwardly and accept a rope that can be tied therearound.

The recreational boater may often have the assistance of someone on the boat as well as someone on the dock as the docking operation is performed. Commonly, long ropes will be thrown from the boat to an assistant who is then able to pull on the rope to reposition the boat.

More commonly, however, the recreational boater will be in a situation wherein he/she will be without any assistance from the dock. The boater is thus faced with the task of laterally repositioning the boat from a position within the boat that is spaced from dock. This procedure is normally attempted in one of two different ways.

The boater may have one or more ropes with a pre-formed, restrictable lasso which the boater may toss towards the dock cleat in an attempt to surround the same with the loop defined by the lasso. If successful, the boater may then pull upon the rope to draw the boat to against the dock.

This procedure requires a certain amount of skill in throwing the rope. Inevitably, several efforts may be unsuccessful. If the lasso has a restrictable loop, each time the failed attempt is completed, the boater may be required to re-enlarge the loop preparatory to a subsequent effort.

While in calm conditions, this trial and error effort may not have significant consequences other than being an inconvenience, in rough conditions, the delay in securing the rope may permit winds or wake to reposition the boat either away from the dock or dangerously towards another structure or boat.

Alternatively, boat hooks are used. Typically such a boat hook will have an elongate pole with a hook at a distal end thereof. The boater manipulates the proximal end of the pole to engage the hook on some type of structure at the dock and then draws the boat towards the dock by exerting a pulling force on the proximal end of the pole.

While use of boat hooks may be preferred by reason of being able to more reliably engage the dock therewith, boat hooks have some inherent drawbacks. First of all, the docking process typically involves two distinct steps when a boat hook is employed. That is, the hook is manipulated to draw the boat towards the dock, whereupon a separate rope must be secured between the boat and a cleat, or other structure, on the dock. In calm conditions, this two-step process may be moderately inconvenient. In rough conditions with a single boater performing the docking operation, it may be awkward to serially perform the steps without losing some control over the position of the boat.

Additionally, with large or heavy boats, the capacity of the boat hook must be substantial or alternatively there is a risk of the same failing during use.

The industry has developed a number of rope control mechanisms wherein a looped rope can be maneuvered to place the loop around a cantilevered object, such as a cleat. Exemplary structures are shown in U.S. Pat. Nos. 2,811,127 (Palsson); 3,677,597 (Stipek); 3,841,685 (Kolodziej); 3,918,385 (Wallace); 4,667,617 (Molitor); 5,009,181 (Upchurch); 5,116,260 (Upchurch); and 5,799,602 (Trillo). Generally, these structures are less than optimal by reason of their being either complicated in nature or less than convenient to use.

Ideally, a boater would have a lightweight structure that is both simple and reliable to use, whereby a lone individual on a boat might be able to readily, conveniently, and safely complete the docking of a boat.

SUMMARY OF THE INVENTION

In one form, the invention is directed to a method of directing a rope around a cantilevered support. The method includes the steps of a) providing an apparatus for controlling the rope having i) an elongate pole with a length and a proximal region and a distal region spaced from each other in a lengthwise direction, and ii) a rope engaging assembly at the distal region of the elongate pole, the rope engaging assembly having at least one surface facing generally in a lengthwise direction away from the proximal region; b) configuring the rope so that the rope bears against the at least one surface and a portion thereof is thereby formed to be generally U-shaped opening towards the proximal region with the rope in an operative position on the apparatus; c) holding at least a second portion of the rope and the elongate pole at the proximal region so that the rope is borne against the at least one surface to maintain the U-shaped rope portion in the "U" shape; and d) manipulating the elongate pole with the rope in the operative position to cause the U-shaped portion of the rope to be directed around the cantilevered support.

In one form, the method includes the step of exerting a force on the rope at a first location spaced from the U-shaped portion to tension the rope between the cantilevered support and the first location.

In one form, the rope engaging assembly consists of two discrete surfaces that are spaced transversely from each other with respect to the length of the pole.

In one form, the rope engaging assembly has a U-shaped body that opens away from the proximal region of the pole. The body has a base and spaced first and second legs that terminate at first and second free ends. The two discrete surfaces are located one each at the first and second free ends.

One discrete surface may be defined by a first fitting having a first surface bounding a first U-shaped receptacle. The first surface has a base portion and first and second spaced leg portions that cooperatively define a "U" shape. The base portion defines the one discrete surface.

In one form, the pole has a lengthwise central axis and the first U-shaped receptacle opens in a line that is non-parallel to the central axis of the pole.

In one form, the other discrete surface is defined by a second fitting having a second surface bounding a second U-shaped receptacle. The second surface has a base portion and first and second leg portions that cooperatively define a "U" shape. The base portion on the second fitting defines the other of the two discrete surfaces.

In one form, the first U-shaped receptacle opens in a first line and the second U-shaped receptacle opens in a second line. The first and second lines define a "V" shape through which the central lengthwise axis of the elongate pole extends.

In one form, the central lengthwise axis substantially bisects the "V" shape.

The first surface may be made from a material that resists sliding movement of the rope thereagainst.

In one form, with the rope in the operative position, the rope is releasably frictionally held between the first and second leg portions on the first fitting.

In one form, the step of holding at least a second portion of the rope comprises holding at least a second portion of the rope from a floating vessel that is spaced from the cantilevered support. The step of exerting a force on the rope involves exerting a force on the rope to thereby cause the floating vessel to be moved towards the cantilevered support.

In one form, the method further includes the step of securing the rope at the cantilevered support to thereby maintain a desired relationship between the floating vessel and the cantilevered support.

In one form, the method includes the step of separating the apparatus from the rope by translating the apparatus away from the U-shaped portion of the rope by movement of the apparatus relative to the rope in a direction in which the U-shaped portion of the rope opens.

In one form, the step of configuring the rope involves configuring the rope into a loop to define the U-shaped portion.

In one form, the step of configuring the rope involves configuring the rope into a loop with a restrictable diameter and the step of exerting a force on the rope involves exerting a force on the rope to tension the rope and thereby reduce the diameter of the loop.

In one form, the elongate pole and a first rope engaging assembly are independent components that are releasably connected together.

In one form, the method further includes the step of providing a second rope engaging assembly that has a different configuration than the first rope engaging assembly and the first and second rope engaging assemblies are selectively connectable to the elongate pole, one in place of the other, thereby to choose a desired configuration for the apparatus.

In one form, the invention is directed to the combination of an apparatus for controlling a rope and a rope that is in an operative position on the apparatus. The apparatus has: i) an elongate pole with a length and proximal and distal regions spaced in a lengthwise direction; and ii) a rope engaging assembly at the distal region of the elongate pole. The rope engaging assembly has at least one surface facing generally in a lengthwise direction away from the proximal region. The rope in the operative position is configured to bear against the at least one surface so that a portion of the rope is U-shaped opening towards the proximal region with at least a second portion of the rope extending towards the proximal region of the pole so that a force can be exerted on the at least second portion of the rope to maintain the portion of the rope that bears against the at least one surface U-shaped. The rope engaging assembly is configured so that the rope can be selectively placed into the operative position and separated from the rope engaging assembly by relatively translating the rope and rope engaging assembly.

In one form, the rope engaging assembly has two discrete surfaces that are spaced transversely from each other with respect to the length of the pole.

In one form, the rope engaging assembly has a U-shaped body that opens away from the proximal region of the pole. The body has a base and spaced first and second legs that terminate at first and second free ends. One of the two discrete surfaces is located at each of the first and second free ends.

In one form, one discrete surface is defined by a first fitting having a first surface bounding a first U-shaped receptacle. The first surface has a base portion and first and second spaced leg portions that cooperatively define a "U" shape. The base portion defines the one discrete surface.

In one form, the pole has a lengthwise central axis and the first U-shaped receptacle opens in a line that is non-parallel to the central axis of the pole.

In one form, the other discrete surface is defined by a second fitting having a second surface bounding a second U-shaped receptacle. The second surface has a base portion and first and second leg portions that cooperatively define a "U" shape. The base portion on the second fitting defines the other of the two discrete surfaces.

In one form, the first U-shaped receptacle opens in a first line and the second U-shaped receptacle opens in a second line. The first and second lines define a "V" shape through which the central lengthwise axis of the elongate pole extends.

In one form, the central lengthwise axis substantially bisects the "V" shape.

In one form, the first surface is made from a material that resists sliding movement of the rope thereagainst.

In one form, with the rope in the operative position, the rope is releasably frictionally held between the first and second leg portions on the first fitting.

DETAILED DESCRIPTION OF THE DRAWINGS

Figure 1:
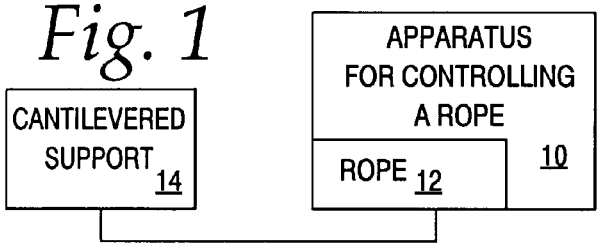
FIG. 1 is a schematic representation of an apparatus for controlling a rope, according to the present invention, used to engage the rope with a cantilevered support.

As seen in FIG. 1, the invention is directed to an apparatus 10 for controlling a rope 12 so as to allow the rope 12 to be extended around a cantilevered support 14 from a position spaced from the cantilevered support 14. The invention is shown in FIG. 1 in schematic form so as to encompass virtually an unlimited number of different environments in which the inventive apparatus 10 could be utilized. The apparatus 10 can be used to direct the rope around a cantilevered support 14 that may project upwardly, downwardly, horizontally, etc., in virtually any environment in which it is desirable to wrap the rope 12 around a support 14 from a spaced location.

Figure 2:
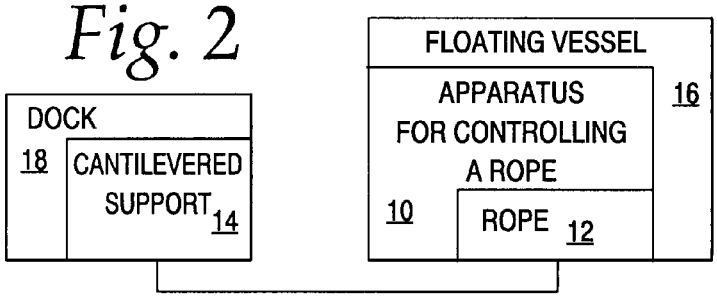
FIG. 2 is a schematic representation, as in FIG. 1, and showing a more specific environment in which the invention is used, with a floating vessel that is secured through a rope to a cantilevered support on a dock.

The apparatus 10 is particularly adaptable for use in one particular environment, as shown schematically in FIG. 2. The apparatus 10 is operated thereon from a boat/floating vessel ("vessel") 16 so that the rope 12 can be placed around the cantilevered support 14, as upon a dock 18, with the floating vessel 16 spaced from the dock 18. The cantilevered support 14 may be a piling, a cleat, or any structure which lends itself to being wrapped around by the rope 12 from a spaced location.

Figure 3:
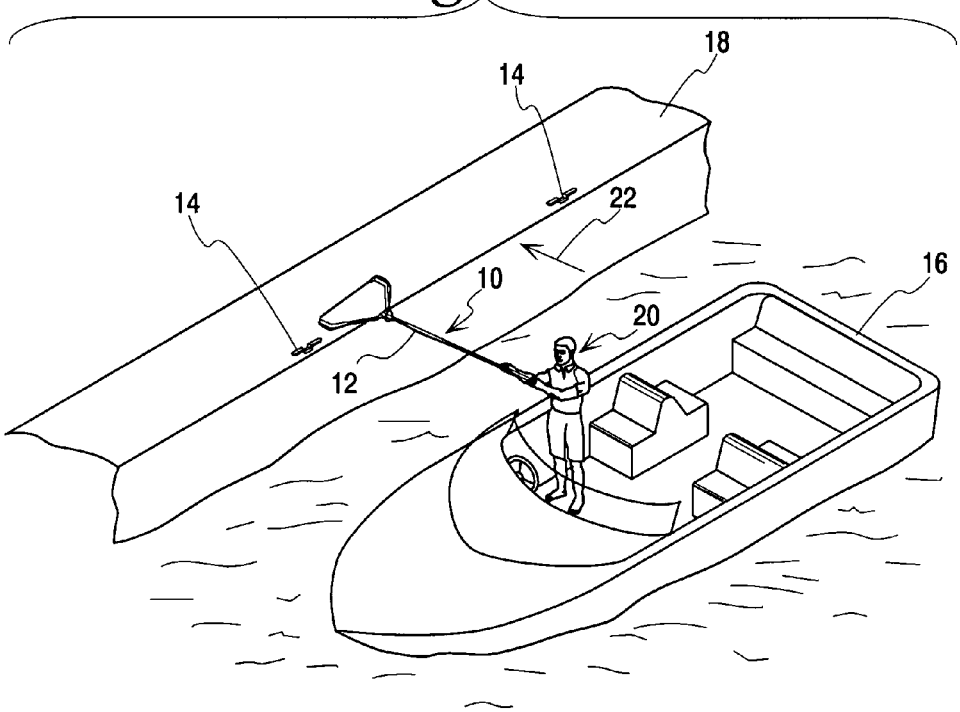
FIG. 3 is a more specific depiction of the environment in FIG. 2.
Figure 5:
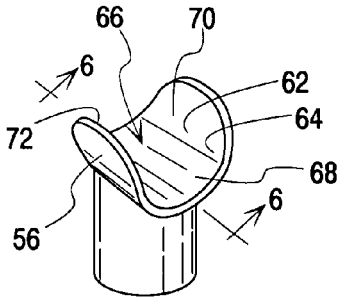
FIG. 5 is an enlarged, perspective view of one of two fittings for engaging the rope on the rope engaging assembly in FIG. 4.
Figure 6:
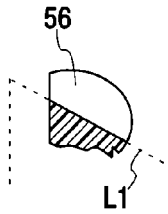
FIG. 6 is a partial cross-sectional view of the fitting taken along lines 6-6 of FIG. 5.

One more specific depiction of the environment in FIG. 2 is shown in FIG. 3. In FIG. 3, a user 20 is shown upon the vessel 16 that is spaced from the dock 18 on which upwardly extending cleats 14 are provided. The apparatus 10 is projected by the user 20 from the vessel 16 to cause the rope 12 to be wrapped around one of the cleats 14 whereupon the user 20 can exert a tension on the rope 12 to draw the vessel 16 in the direction of the arrow 22 towards the dock 18. The rope 12 can be used temporarily to hold vessel 16 in place or may be subsequently tied to both the cleat 14 and vessel 16 to maintain the vessel 16 in a desired docked position.

One preferred form of the apparatus 10, and its interaction with the rope 12, is shown in FIGS. 4-7. The apparatus 10 consists of an elongate pole 24 having a lengthwise central axis 26 and proximal and distal regions 28, 30, respectively, spaced lengthwise from each other relative to the axis 26. The pole 24 may have a fixed length, may have joinable parts, or may consist of telescopingly engaged parts that permit selective length variation. The proximal and distal regions 28, 30, while shown at the lengthwise extremities of the pole 24, are not limited to being at these precise locations.

The proximal end 28 has a grip 32 around which a user's hand can be extended to comfortably grasp and manipulate the elongate pole 24. Other types of structure might be used, such as a closed loop, etc.

A free end 34 at the distal region 30 of the pole 24 is designed to telescopingly engage a stub shaft 36 on a rope engaging assembly 38. With the stub shaft 36 and pole end 34 telescopingly engaged, one within the other, openings 40, 42, respectively in the pole 24 and rope engaging assembly 38, register to allow direction therethrough of a bolt or a pin (not shown). The invention contemplates that any type of mechanism, shown schematically at 44 in FIG. 4, might be utilized to releasably or permanently maintain the connection between the pole 24 and rope engaging assembly 38.

For example, the mechanism 44 may be a detent arrangement which allows a user to depress a spring-loaded component to effect release of the connection between the pole 24 and rope engaging assembly 38.

The rope engaging assembly 38 has a U-shaped body 46 with a base 48 and first and second legs 50, 52, extending from the base 48 in a manner that the base 48 and legs 50, 52 cooperatively define the "U" shape. The first leg 50 has a first free end 54 at which a first fitting 56 is provided. The second leg 52 has a second free end 58 at which a second fitting 60 is provided. The first and second fittings 56, 60 may be identical or may have a different configuration. In the embodiment shown, the fittings 56, 60 are the same and are mounted on their respective legs 50, 52 so as to be turned 180° with respect to each other about axes parallel to the central axis 26 of the pole 24.

The exemplary fitting 56 has a body 62 with a first surface 64 bounding a U-shaped receptacle 66. The receptacle 66 is bounded by a base surface portion (surface) 68 and first and second leg surface portions 70, 72, respectively, spaced widthwise of the surface 68.

The second fitting 60 has a receptacle 66' bounded by a base surface 68', corresponding to the base surface 68 on the first fitting 56.

The two discrete surface 68, 68' are arcuate/gently curved and have straight lengths that extend generally along lines L1, L2, respectively, that make a V-shape with respect to each other. The axis 26 of the pole 24 extends through the "V" and preferably bisects the same.

Figure 7:
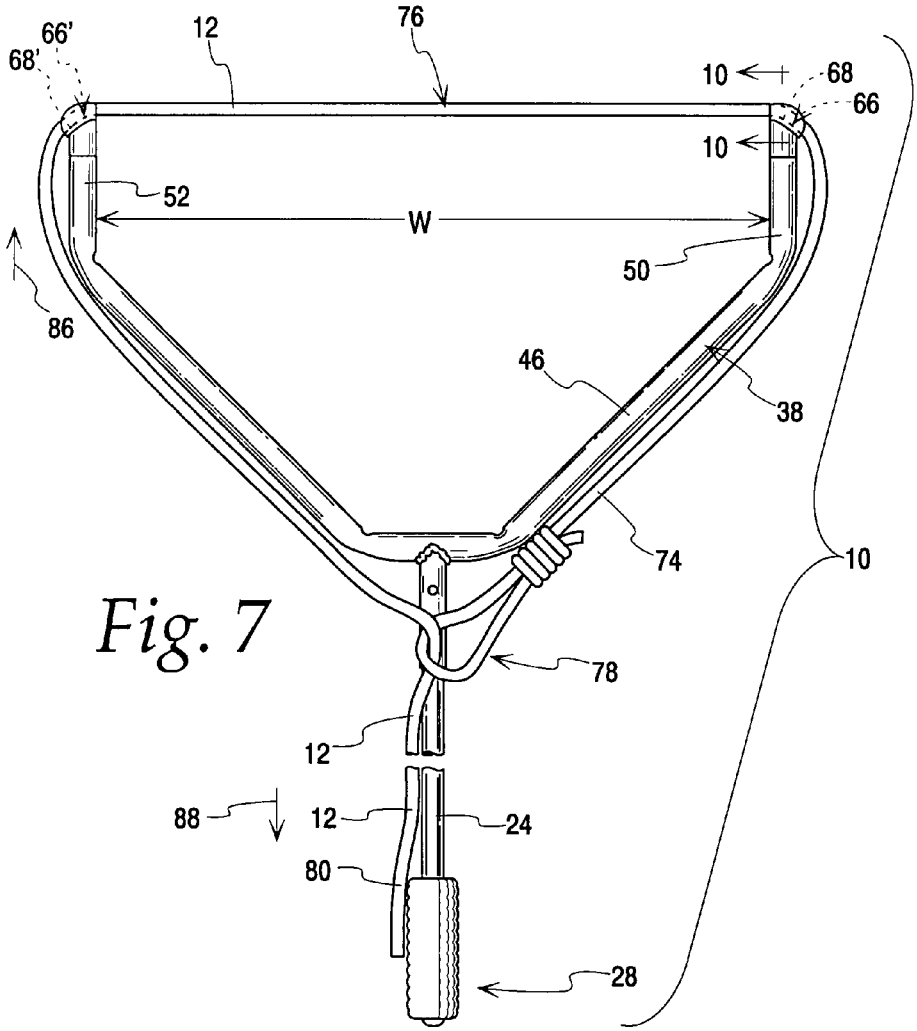
FIG. 7 is a view of the apparatus as in FIG. 4 and with a rope in an operative position and configured to define a restrictable loop.

The receptacle 66 on the first fitting 56, and the corresponding receptacle 66' on the second fitting 60, open away from the proximal region 28 of the pole 24 and allow the rope 12 to be placed in an operative position upon the apparatus 10, as shown in FIG. 7. The rope 12 is formed to define either a fixed, or in this case a restrictable, loop 74. The rope 12 is placed into the receptacles 66, 66' to bear against the surfaces 68, 68'. With the rope 12 configured in this manner, a portion of the rope at 76 is U-shaped opening towards the proximal region 28 of the pole 24. The effective usable width (W)/diameter of the loop 74 at the U-shaped portion 76 is determined primarily by the spacing between the legs 50, 52 of the body 46 of the rope engaging assembly 38. A slip knot 78 is formed in the rope 12, such that a second portion 80 of the rope 12 is directed back towards the proximal region 28 of the pole 24, to be grasped in the vicinity thereof together with the proximal region 28 of the pole 24. Alternatively, a preformed eye can be formed in the rope 12 to allow a free end of the rope 12 to be directed therethrough to form a similarly functioning restrictable loop.

Figure 8:
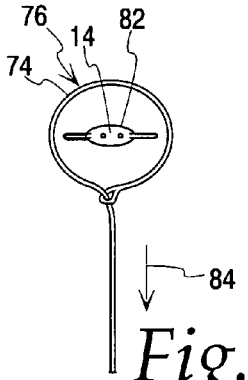
FIG. 8 is a reduced, fragmentary plan view of a support with the loop placed therearound using the apparatus and the apparatus separated from the rope.
Figure 9:
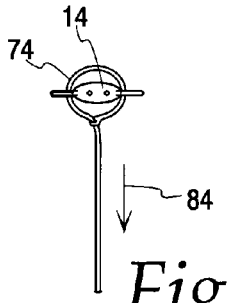
FIG. 9 is a view as in FIG. 8 wherein the loop is reduced in diameter from that shown in FIG. 8.

With the rope 12 and apparatus 10 in the configuration shown in FIG. 7, the apparatus 10 can be manipulated, as shown particularly in FIGS. 3, 8 and 9, to place the loop 74 around the support 14. With the loop 74 in the FIG. 8 orientation, the U-shaped portion 76 of the rope wraps around a portion 82 of the support facing away from the user at the proximal pole end 28. By separating the apparatus 10 from the rope 12, the user can then exert a force in the direction of the arrow 84 upon the rope portion 80, thereby to tension the rope 12 between the support portion 82 and rope portion 80 and restrict the loop 74 so as to tightly embrace the support 14.

In the embodiment shown, the configuration of the rope engaging assembly 38 is such that it can be moved by simple translational movement in the direction of the arrow 86 in FIG. 7 into the loop 74. This causes the rope to seat in the receptacles 66, 66'. It is actually generally more convenient for the user to configure the loop 74 by causing the rope 12 to be placed serially into the receptacles 66, 66'. When it is desired to separate the apparatus 10 from the rope 12, the apparatus 10 is translated oppositely to the direction of the arrow 86 to move the rope 12 out of the receptacles 66, 66', thereby to allow complete separation of the apparatus 10 from the rope 12. This can be accomplished with the U-shaped portion 76 of the rope 12 braced against the support portion 82.

By maintaining a slight tension on the second portion 80 of the rope 12 in the direction of the arrow 88, the rope 12 can be maintained within the receptacles 66, 66 to maintain the "U" shape of the rope portion 76 as the apparatus 10 is manipulated as described above to place the loop 76 around the support 14. The U-shaped body 46 is rigid sufficiently that the body 46 does not appreciably bend as the rope 12 is tensioned against the surfaces 68, 68' to maintain the rope 12 in a predetermined shape upon the body 46.

Figure 10:
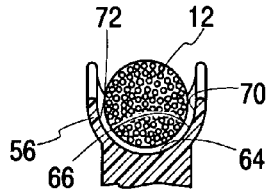
FIG. 10 is an enlarged, cross-sectional view of one of the fittings on the rope engaging assembly with the rope thereon taken along line 10-10 of FIG. 7.

The rope 12 can also be maintained within the exemplary receptacle 66 in FIG. 10 by configuring the fitting 56 so that the leg surface portions 70, 72 cooperatively frictionally grip the diameter of the rope 12. The entire fitting 56, or at least a part of the surface 64 thereon, may be made from a material that resists sliding movement to the rope 12. The configuration of the receptacles 66, 66', and the nature of the material bounding the receptacle 66, 66' can be selected to maintain the rope 12 in its operative position without significant effort on the part of the user, while at the same time allowing convenient separation of the apparatus 10 and rope 12 at the appropriate time.

Figure 11:
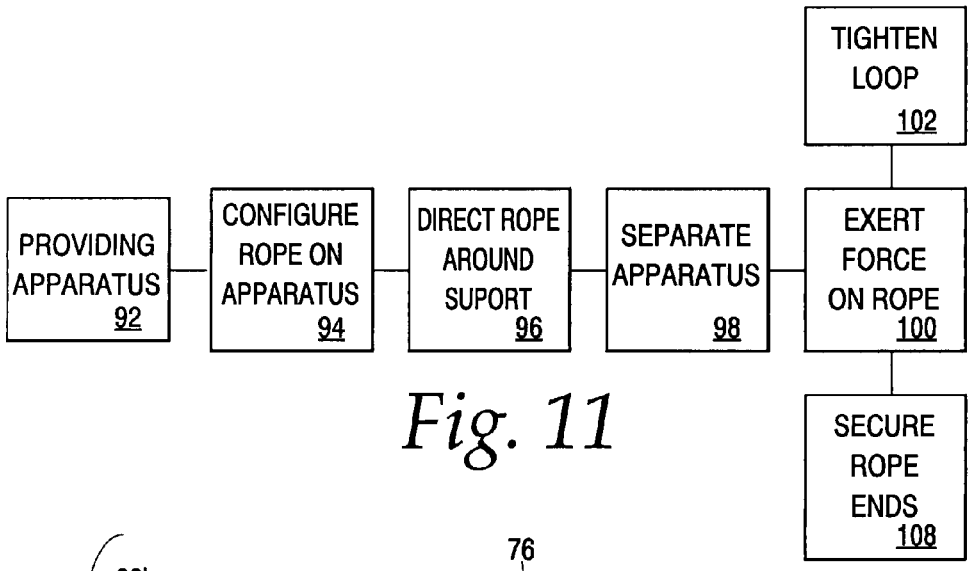
FIG. 11 is a schematic representation of a method of controlling a rope according to the invention.

Accordingly, as shown schematically in FIG. 11, docking of the vessel 16 can be carried out as follows. The apparatus 10 is provided in the form described above, or in another form, as shown at block 92. The rope 12 is configured in its operative position, as shown in FIG. 7, as shown at block 94. In the FIG. 7 configuration, the apparatus 10 can be repositioned to place the loop 74 around the support 14, as shown at block 96. Thereafter, as shown at block 98, the rope engaging assembly 38 on the apparatus 10 is separated from the rope 12. The user is then allowed to draw the U-shaped portion 76 of the rope 12 against the support 14 so that the force exerted on the rope produces a tension between the second rope location 88 and the support 14 at which the U-shaped portion 76 engages, as shown at block 100. With the restrictable loop configuration shown in FIGS. 7-9, further force application causes the loop 74 tighten and thereby to restrict/reduce in diameter, as shown at block 102.

Figure 12:
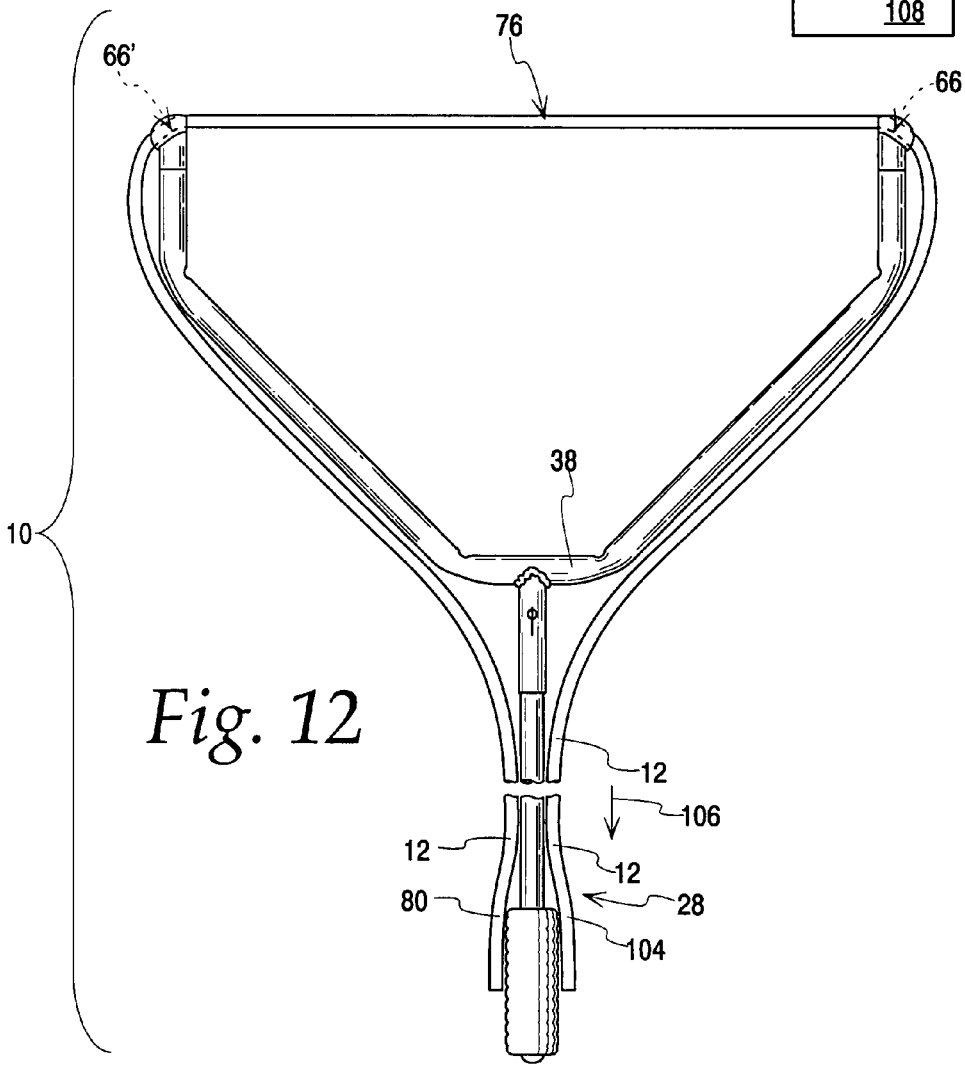
FIG. 12 is a view as in FIG. 7 wherein the rope is configured in a different manner to be controlled using the apparatus.

As an alternative to using a restrictable loop, as shown in FIG. 12, the rope 12 can be wrapped around the rope engaging assembly 38 to produce the U-shape portion 76. However, instead of having a restrictable loop, a third portion 104 of the rope 12 is directed back to the proximal pole region 28. By exerting a force on both rope portions 80, 104 in the direction of the arrow 106 in FIG. 12, the shape of the U-shaped portion 76 can be maintained with the rope 12 residing within the receptacles 66, 66' in the same manner as for the arrangement shown in FIG. 7. The U-shaped portion 76 can then be directed around the support 14, whereupon the apparatus 10 can be separated from the rope 12, as previously described. The user can then draw the rope portions 80, 104 to produce a tension on the rope 12 between the U-shaped portion 76 bearing upon the support 14 and the rope portions 80, 104. Through this tensioning action, the vessel 16 within which the user 20 resides can be pulled towards the dock 18.

Once the vessel 16 is in the desired position, the rope 12 can be secured to the support 14 and vessel 16, as desired. Alternatively, another rope or holding mechanism may be used to accomplish this. This step is shown at block 108 in FIG. 11.

With the embodiment in FIG. 7, the rope 12 can be used to secure the vessel 16 and/or another rope or ropes or other mechanism can be used to secure the vessel 16 at the desired location on the dock 18.

The invention contemplates numerous variations from the basic structures described above. For example, the entire apparatus 10 can be made as one piece as opposed to having separate components, in this case the joinable pole 24 and rope engaging assembly 38.

The depicted configuration of the body 46 on the rope engaging assembly 38 is not in any way intended to be limiting. All that is required with this design is that there be two spaced, discrete surfaces 68, 68' that can be bridged by the rope 12 to define the U-shaped portion 76 that can be directed around the support 14 as the apparatus 10 is operated. As just an example, the "U" shape of the body 46 may be off center with respect to the axis 26 of the pole 24, and potentially fully offset therefrom.

Further, the shape of the discrete surfaces 68, 68' is not critical to the present invention. The function of the surfaces 68, 68' could be performed by, for example, sharp pins, the ends of which would be considered "surfaces", as used herein.

The spacing of the surfaces 68, 68' can be changed depending upon the particular application and the nature of the support 14.

Figure 4:
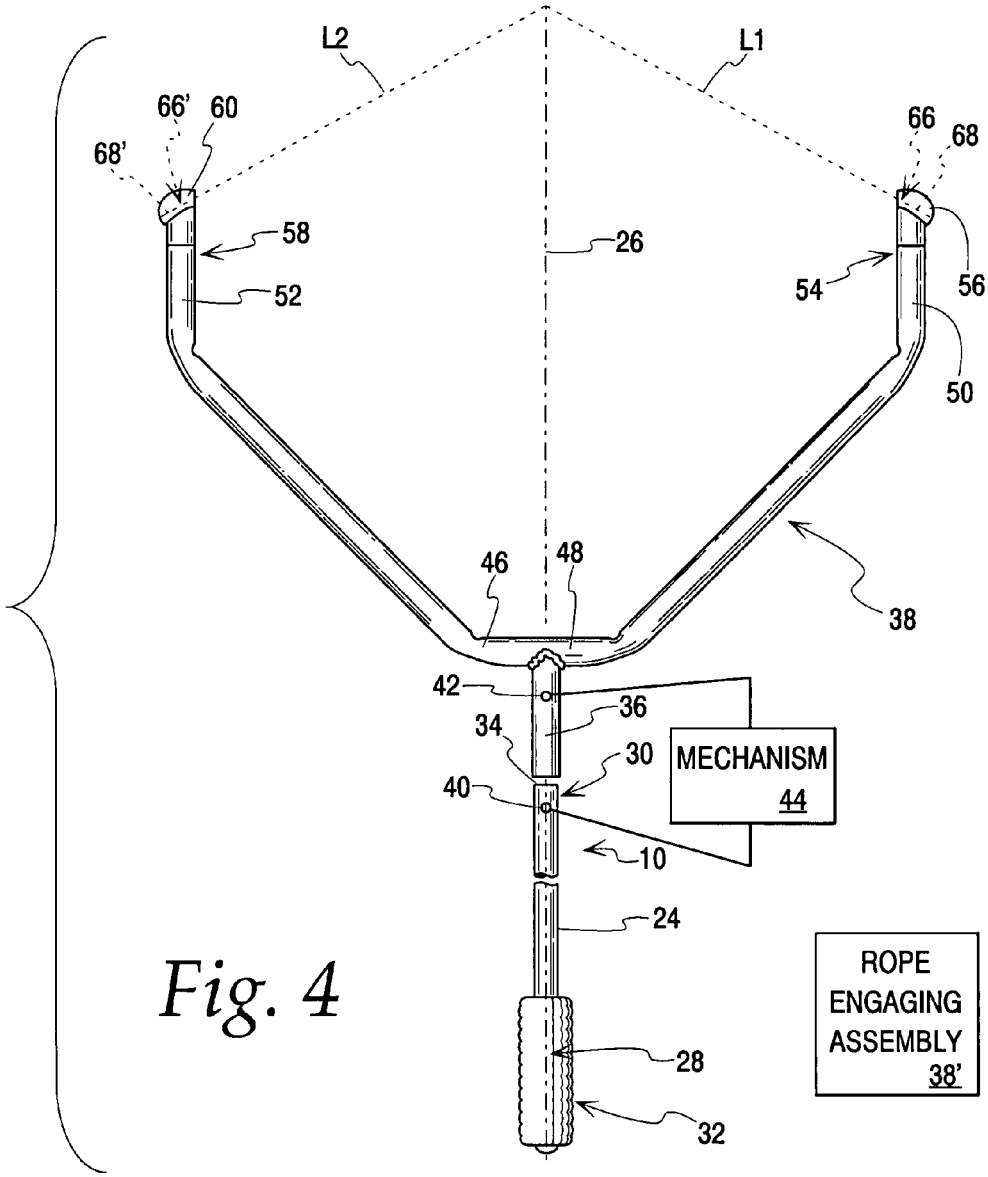
FIG. 4 is an exploded, top view of an apparatus for controlling a rope, according to the present invention, and consisting of a pole and a rope engaging assembly for supporting the rope in an operative position.

As a further alternative, as shown in FIG. 4, an optional interchangeable rope engaging assembly 38' may be provided that has a different configuration than the rope engaging assembly 38. The user can selectively use either of the rope engaging assemblies 38, 38', in place of the other, on the pole 24 to produce the desired configuration.

The apparatus 10 may be made from any of a number of different materials, such as metal, plastic, or a composite. The fittings 56, 60 could be integrally formed with the remainder of the body 48. They are shown as separate elements in this design in that this facilitates separate formation of the fittings 56, 60 with a material that has frictional properties that are more preferred than those of the material making up the rest of the body 46. For example, the fittings 56, 60 could be molded from a plastic material. The plastic material may flex to accept a larger diameter rope that may be squeezed therein. Additionally, the plastic may be treated so that its frictional characteristics are appropriate to avoid unwanted slippage between the rope 12 and fittings 56, 60.

With the structure shown, the U-shaped rope portion 12 can be resituated while being relatively firmly maintained in the "U" shape. The user is thus not faced with the problem that the loop will close as the apparatus is moved. This facilitates alignment of the loop 74 with a support and direction of the loop 74 therearound.

The foregoing disclosure of specific embodiments is intended to be illustrative of the broad concepts comprehended by the invention.

The invention claimed is:

1. A method of directing a rope around a cantilevered support, the method comprising the steps of:

a) providing an apparatus for controlling a rope, the apparatus comprising:

an elongate pole with a length and having a proximal region and a distal region spaced from each other in a lengthwise direction; and a rope engaging assembly at the distal region of the elongate pole, the rope engaging assembly comprising a rigid, U-shaped body that opens away from the proximal region of the pole, the U-shaped body comprising a base and first and second legs, the rope engaging assembly further comprising first and second discrete surfaces respectively on the first and second legs against which the rope can be drawn by exerting a force upon the rope through manipulation of the rope from adjacent the proximal region, the U-shaped body having sufficient rigidity that the rope acting against the first and second discrete surfaces will not cause the U-shaped body to bend as a force is exerted upon the rope from at the proximal region tending to bear the rope against the first and second discrete surfaces;

b) configuring the rope so that the rope bears against the first and second discrete surfaces and a portion of the rope is thereby formed to be generally U-shaped opening towards the proximal region with the rope in an operative position on the apparatus;

c) holding at least a second portion of the rope and the elongate pole at the proximal region so that the rope is borne against the first and second discrete surfaces to maintain the U-shaped rope portion in the "U" shape; and d) manipulating the elongate pole with the rope in the operative position to cause the U-shaped portion of the rope to be directed around the cantilevered support.

2. The method of directing a rope around a cantilevered support according to claim 1 further comprising the step of exerting a force on the rope at a first location spaced from the U-shaped portion to tension the rope between the cantilevered support and the first location.

3. The method of directing a rope around a cantilevered support according to claim 1 wherein the step of providing an apparatus comprises providing an apparatus wherein the two discrete surfaces are spaced transversely from each other with respect to the length of the pole.

4. The method of directing a rope around a cantilevered support according to claim 3 wherein the first and second legs terminate at first and second free ends and the two discrete surfaces are located one each at the first and second free ends.

5. The method of directing a rope around a cantilevered support according to claim 4 wherein the first discrete surface is defined by a first fitting having a first surface bounding a first U-shaped receptacle, the first surface having a gently curved base portion and first and second spaced leg portions that cooperatively define a "U" shape, and the base portion defines the first discrete surface.

6. The method of directing a rope around a cantilevered support according to claim 5 wherein the pole has a lengthwise central axis and the first U-shaped receptacle opens in a line that is non-parallel to the central axis of the pole.

7. The method of directing a rope around a cantilevered support according to claim 5 wherein the second discrete surface is defined by a second fitting having a second surface bounding a second U-shaped receptacle, the second surface having a base portion and first and second leg portions that cooperatively define a "U" shape, and the base portion on the second fitting defines the second discrete surface.

8. The method of directing a rope around a cantilevered support according to claim 7 wherein the base portion on the first U-shaped receptacle has a length that extends along a first line and the base portion on the second U-shaped receptacle has a length that extends along a second line and the first and second lines define a "V" shape through which the central lengthwise axis of the elongate pole extends.

9. The method of directing a rope around a cantilevered support according to claim 8 wherein the central lengthwise axis substantially bisects the "V" shape.

10. The method of directing a rope around a cantilevered support according to claim 5 wherein the first surface is made from a material that resists sliding movement of the rope thereagainst.

11. The method of directing a rope around a cantilevered support according to claim 5 wherein with the rope in the operative position, the rope is releasably frictionally held between the first and second leg portions on the first fitting.

12. The method of directing a rope around a cantilevered support according to claim 2 wherein the step of holding at least a second portion of the rope comprises holding at least a second portion of the rope from a floating vessel that is spaced from the cantilevered support, and the step of exerting a force on the rope comprises exerting a force on the rope to thereby cause the floating vessel to be moved towards the cantilevered support.

13. The method of directing a rope around a cantilevered support according to claim 12 further comprising the step of securing the rope at the cantilevered support to thereby maintain a desired relationship between the floating vessel and the cantilevered support.

14. The method of directing a rope around a cantilevered support according to claim 13 further comprising the step of separating the apparatus for controlling the rope from the rope by translating the apparatus away from the U-shaped portion of the rope by movement of the apparatus relative to the rope in a direction in which the U-shaped portion of the rope opens.

15. The method of directing a rope around a cantilevered support according to claim 2 wherein the step of configuring the rope comprises configuring the rope into a loop with a restrictable diameter and the step of exerting a force on the rope comprise exerting a force on the rope to tension the rope and thereby reduce the diameter of the loop.

16. The method of directing a rope around a cantilevered support according to claim 1 wherein the step of configuring the rope comprises configuring the rope into a loop to define the U-shaped portion.

17. The method of directing a rope around a cantilevered support according to claim 1 wherein the step of providing an apparatus comprises providing an apparatus wherein an elongate pole and rope engaging assembly that are independent components are releasably connected together.

18. The method of directing a rope around a cantilevered support according to claim 17 further comprising the step of providing a second rope engaging assembly that has a different configuration than the first claimed rope engaging assembly and the first claimed and second rope engaging assemblies are selectively connectable to the elongate pole, one in place of the other, thereby to choose a desired configuration for the apparatus.

19. In combination:

a) an apparatus for controlling a rope comprising:

an elongate pole with a length and having a proximal region and a distal region spaced from each other in a lengthwise direction; and a rope engaging assembly at the distal region of the elongate pole, the rope engaging assembly comprising a rigid U-shaped body that opens away from the proximal region of the pole, the U-shaped body comprising a base and first and second legs and first and second discrete surfaces respectively on the first and second legs;

b) a rope that is in an operative position on the apparatus; and the rope in the operative position configured to bear against the first and second discrete surfaces so that a portion of the rope is U-shaped opening towards the proximal region with at least a second portion of the rope extending towards the proximal region of the pole so that a force can be exerted on the at least second portion of the rope to maintain the portion of the rope that bears against the at least one surface U-shaped, the rope engaging assembly configured so that the rope can be selectively placed into the operative position and separated from the rope engaging assembly by relatively translating the rope and rope engaging assembly, the U-shaped body having sufficient rigidity that the rope acting against the first and second discrete surfaces will not cause the U-shaped body to bend as a force is exerted upon the rope from at the proximal region tending to bear the rope against the first and second discrete surfaces.

20. The combination according to claim 19 wherein the first and second discrete surfaces are spaced transversely from each other with respect to the length of the pole.

21. The combination according to claim 20 wherein the first and second legs terminate at first and second free ends and the first and second discrete surfaces are located one each at the first and second free ends.

22. The combination according to claim 21 wherein the first discrete surface is defined by a first fitting having a first surface bounding a first U-shaped receptacle, the first surface having a base portion and first and second spaced leg portions that cooperatively define a "U" shape, and the base portion defines the first discrete surface.

23. The combination according to claim 22 wherein the pole has a lengthwise central axis and the first U-shaped receptacle opens in a line that is non-parallel to the central axis of the pole.

24. The combination according to claim 22 wherein the second discrete surface is defined by a second fitting having a second surface bounding a second U-shaped receptacle, the second surface having a base portion and first and second leg portions that cooperatively define a "U" shape, and the base portion on the second fitting defines the second discrete surface.

25. The combination according to claim 22 wherein the first surface is made from a material that resists sliding movement of the rope thereagainst.

26. The combination according to claim 22 wherein with the rope in the operative position, the rope is releasably frictionally held between the first and second leg portions on the first fitting.

27. The combination according to claim 19 wherein the first and second discrete surfaces have lengths extending along first and second lines that define a "V" shape opening toward the proximal region.

28. The combination according to claim 27 wherein the central lengthwise axis of the elongate pole extends through the "V" shape.

29. The combination according to claim 28 wherein the central lengthwise axis substantially bisects the "V" shape.

* * * * *